United States Patent [19]

Raasch

[11] 4,055,936

[45] Nov. 1, 1977

[54] METHOD FOR TERMINATING A SPINNING OPERATION

[75] Inventor: Hans Raasch, Monchen-Gladbach, Germany

[73] Assignee: W. Schlafhorst & Co., Monchen-Gladbach, Germany

[21] Appl. No.: 686,465

[22] Filed: May 14, 1976

[30] Foreign Application Priority Data

May 16, 1975 Germany ..... 2521850

[51] Int. Cl.[2] ..... D01H 9/16

[52] U.S. Cl. ..... 57/34 R; 57/86; 57/156

[58] Field of Search ..... 57/34 R, 156, 58.95, 57/86–87; 19/.2

[56] References Cited

U.S. PATENT DOCUMENTS

| | | | |
|---|---|---|---|
| 1,973,552 | 9/1934 | Williamson | 57/87 X |
| 3,643,883 | 2/1972 | Wuest | 57/86 X |
| 3,695,022 | 10/1972 | Landwehrkamp | 57/87 X |
| 3,751,896 | 8/1973 | Ford | 57/87 |
| 3,858,385 | 1/1975 | Shinkai et al. | 57/58.95 X |
| 3,884,027 | 5/1975 | Schumann et al. | 57/58.95 X |
| 3,950,926 | 4/1976 | Skiblecker | 57/58.95 X |

*Primary Examiner*—Richard C. Queisser
*Assistant Examiner*—Charles Gorenstein
*Attorney, Agent, or Firm*—Herbert L. Lerner

[57] ABSTRACT

A method for terminating the spinning operation in a spinning machine having a loosening-up and a feeding device for slivers, includes the steps of running a sliver having a substantially full cross section with a substantially uniform count over the entire length thereof through the sliver feeding device and the fiber loosening-up device, and cleanly cutting the sliver transversely immediately upstream of the feeding device in direction of feed of the sliver; and device for performing the foregoing method.

4 Claims, 1 Drawing Figure

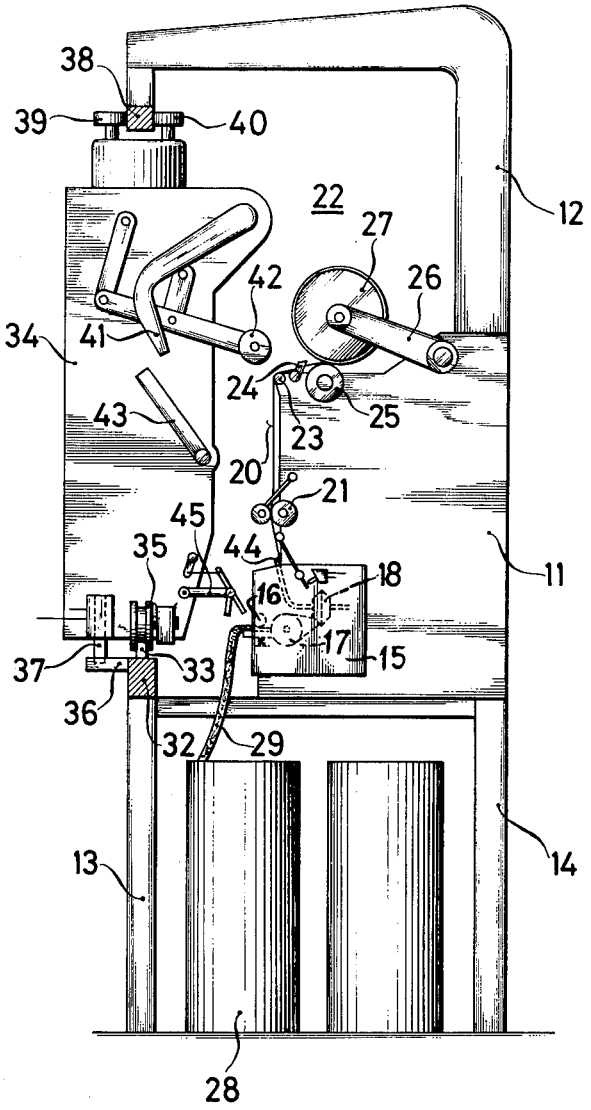
38
39
40
22
27
12
42
26
34
41
24
25
43
23
20
21
45
35
44
18
11
16
17
37
33
15
36
32
29
13
14
28

METHOD FOR TERMINATING A SPINNING OPERATION

SPECIFICATION:

The invention relates to a method and device for terminating a spinning operation for textile yarn or thread in a spinning machine which has a device for loosening-up slivers.

The sliver or roving to be processed by conventional methods is usually fed to the spinning machine from containers, in which the sliver is deposited in the form of loops. The individual fibers of the sliver are connected very loosely to one another. The sliver possesses only a very little twist, the direction of which also varies generally. The beginning and end of the sliver always taper off to a respective point which does not have the normal, full cross section of the sliver. The sliver is conventionally severed by simply being torn off.

At the end of the spinning operation, the spun yarn, especially in open-end spinning machines, does not have the desired counter number, over relatively great lenghts of the yarn, which corresponds to the normal full cross section of the sliver. At the yarn end, in conventional spinning operations, the yarn is always thinner and weaker than the corresponding pre-set desired yarn count or number, and usually tapers off to a very thin thread end, which is wound especially firmly on the bobbin or coil and becomes hooked or entangled with the adjacent thread layers.

The cause of these shortcomings is found in the deviations in the cross section of the slivers at the ends thereof. Even a previously cleanly cut-off sliver tends to shift the fibers thereof out of the plane of the cut upon the slightest of movements. The shifting or displacement of the fibers becomes all the greater as the radius of curvature, when it is being placed in the container, drawn out of the container and introduced into the feeding device, is smaller. In any event, the sliver does not have the normal full cross section at the ends thereof.

The joining or a subsequent rewinding operation that follows the spinnning operation is rendered more difficult because it is hard to find the abnormally thin ends of the spun yarn. Sometimes it is altogether impossible to find the end, and layers of the spun yarn must be removed, with consequent loss of yarn, in order to provide the coil or bobbin with a yarn end that can be gripped.

Furthermore, it is not a simple task to determine where the deviation from the acceptable count or number begins. As measurements have shown, the range of the deviation in cross section is from about 2 to 15 meters long. Since thin portions are involved, it is even more difficult and, in particular, time-consuming to remove such thin portions of relatively great length during a subsequent process of unwinding the spun yarn.

It is, accordingly, an object of the invention to avoid the aforementioned difficulties by providing a method and device for terminating a spinning operation which afford a reduction in the amount of waste yarn and prevention of a change in the yarn count or number toward the end of the winding operation.

With the foregoing and other objects in view, and beginning with the prior art knowledge that heretofore uncontrollable deviations in the cross section of the sliver at the end thereof cause manifold difficulties during further processing of the yarn being spun, there is provided, in accordance with the invention, in a method for terminating the spinning operation in a spinning machine having a loosening-up and a feeding device for slivers, the step of running a sliver having a substantially full cross section with a substantially uniform count over the entire length thereof through the sliver feeding device and the fiber loosening-up device.

In accordance with another feature of the invention, and in order to ensure that, before the spinning operation is terminated, a full cross section of the sliver will be provided at the end thereof, the method includes cleanly cutting the sliver immediately upstream of the feeding device in direction of feed of the sliver. Shifting or displacement of the fibers out of the severing plane is consequently only possible to a relatively innocuous extent, if at all.

In accordance with the device of the invention for carrying out the method thereof, means are provided, located in the immediate vicinity of the feeding device for transversely severing the sliver with a clean cut.

In accordance with yet another feature of the invention, the severing means may be located at every spinning station. If a special processing device, particularly a joining device, is in operation for a plurality of spinning stations of a spinning machine or a side of the machine, the severing device is advantageously associated with that processing device.

In the use or application of the invention, a surprising, advantageous effect has been found. The spun yarn exhibits at the end thereof a conspicuous tuft of fibers, which is relatively easy to seek out and grip manually, as well as by machine. Along the length of the yarn, up to this fiber tuft, the yarn has the correct count or number. During rewinding or in the spinning machine itself, the fiber tufts are removed in the course of the cleaning operation and the yarn ends are tied together or the yarn end is newly joined. Little waste yarn is produced thereby, and the danger of undesired changes in the yarn number or count is very small.

Other features which are considered as characteristic for the invention are set forth in the appended claims.

Although the invention is illustrated and described herein as embodied in method and device for terminating a spinning operation, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the single FIGURE of the drawing which is a diagrammatic side elevational view of a spinning station of an open end spinning machine embodying the device of the invention.

Referring now to the FIGURE of the drawing, there is shown therein a spinning-machine frame 11 with an arm 12. The machine frame 11 on supports 13 and 14 and carries a conventional spinning device 15, such as is shown, for example, in the copending application of Hans Raasch entitled APPARATUS FOR MONITORING SLIVER FED IN A SPINNING MACHINE Ser. No. 680,052, filed Apr. 26, 1976, which includes a sliver feeding or drawing-in roller 16, a fiber loosening-up device 17 and a spinning turbine 18.

The spun thread 20 is withdrawn from the spinning turbine 18 by a withdrawing roller 21 and is fed to a winding device 22 which includes a guide wire 23, a thread guide 24, a winding cylinder 25 and a coil or bobbin holder 26, which carries the coil or bobbin 27 which is being wound.

Below the spinning device 15 is a container 28 from which a sliver 29 is fed to the feeding roller 16.

On a beam 32, shown in cross section, which extends from spinning station to spinning station, a guide rail 33 is disposed, serving to guide the two lower guide rollers 35 (only one of which is visible) of a joining carriage 34. At the beams 32, a stop 36 is provided with which an electromagnetically actuable latch 37 of the joining carriage 34 is engaged.

Another beam 38 is supported by the arms 12 of the spinning stations and serves to guide the upper guide rollers 39 and 40 of the joining carriage 34. The essential operating elements of the joining carriage 34 are a conventional suction nozzle 41, which fetches the thread 20 from the coil or bobbin 27 in the event of a thread break; a reversing roller 42, which drives the coil or bobbin 27 in unwinding direction in the case of a thread break while the nozzle 42 is searching for the thread; and a pivotable thread feeder 43, which brings the thread from the suction nozzle 41 to a thread delivery or withdrawal tube 44 of the spinning turbine 18. The joining carriage 34 also has a severing device 45 in the form of pivotable scissors.

The joining carriage 34 is activated in a conventional manner at the start of the spinning operation and, again, and in accordance with the invention, the termination of the spinning operation. It travels from spinning station to spinning station and cuts off the sliver 29 cleanly with severing device 45 carried thereby. Due to the clean cut, the sliver runs through the loosening-up device 17 with the full, normal cross section thereof up to the severed end thereof. At the end of the spun thread 20, a fiber tuft is formed.

The operations executed or initiated by the joining carriage are controlled by a programmed timing mechanism, which is not shown in the drawing and does not actually form any part of this invention.

The invention is not limited, as aforementioned, to the embodiment shown and described. The severing device could, for example, also be provided independently of the joining carriage or united with the spinning station.

There are claimed:

1. In a method for terminating the spinning operation in a spinning machine having a loosening-up and a feeding device for slivers, the steps of running a sliver having a substantially full cross section with a substantially uniform count over the entire length thereof through the sliver feeding device and the fiber loosening-up device and cleanly cutting the sliver transversely immediately upstream of the feeding device in direction of feed of the sliver to provide a sliver end which retains said substantially full cross section and substantially uniform count.

2. In apparatus for carrying out a method of terminating the spinning operation in a spinning machine having a loosening-up and a feeding device for slivers, comprising means located immediately upstream of the feeding device for transversely severing said sliver with a clean cut without altering the cross section of said sliver.

3. Apparatus according to claim 2, wherein said severing means is associated with a processing device successively actuable at all spinning stations of at least one side of a spinning machine.

4. Apparatus according to claim 3 wherein said processing device is a joining device.

* * * * *